United States Patent [19]

Haden

[11] Patent Number: 4,707,042

[45] Date of Patent: Nov. 17, 1987

[54] ELECTRICAL SOCKET APPARATUS

[75] Inventor: John D. Haden, Rugeley, England

[73] Assignee: D.H. Haden Limited, West Midlands, England

[21] Appl. No.: 819,148

[22] Filed: Jan. 15, 1986

[30] Foreign Application Priority Data

Feb. 5, 1985 [GB] United Kingdom ..... 8502909
Aug. 3, 1985 [GB] United Kingdom ..... 8519552

[51] Int. Cl.[4] ..... H01R 13/44
[52] U.S. Cl. ..... 439/140
[58] Field of Search ..... 339/40–43

[56] References Cited

U.S. PATENT DOCUMENTS

| | | | |
|---|---|---|---|
| 1,094,806 | 4/1914 | Newton | 339/43 |
| 4,528,429 | 7/1985 | Dobson et al. | 339/40 |
| 4,650,268 | 3/1987 | Dobson et al. | 339/40 |
| 4,655,523 | 4/1987 | Rebel | 339/40 |

FOREIGN PATENT DOCUMENTS

| | | | |
|---|---|---|---|
| 0027244 | 4/1981 | European Pat. Off. . | |
| 364797 | 1/1932 | United Kingdom | 339/43 |
| 467743 | 6/1937 | United Kingdom | 339/43 |
| 531281 | 1/1941 | United Kingdom | 339/43 |
| 537879 | 7/1941 | United Kingdom . | |
| 543347 | 2/1942 | United Kingdom . | |
| 591066 | 8/1947 | United Kingdom . | |
| 623307 | 5/1949 | United Kingdom . | |
| 701292 | 12/1953 | United Kingdom . | |
| 824117 | 11/1959 | United Kingdom . | |
| 976252 | 11/1964 | United Kingdom . | |
| 1151834 | 5/1969 | United Kingdom . | |
| 1210359 | 10/1970 | United Kingdom | 339/40 |
| 1486968 | 9/1977 | United Kingdom . | |
| 2039164 | 7/1980 | United Kingdom . | |

*Primary Examiner*—Gil Weidenfeld
*Assistant Examiner*—Paula A. Austin
*Attorney, Agent, or Firm*—Becker & Becker, Inc.

[57] ABSTRACT

Electrical socket apparatus, for example, for safety supporting and supplying electricity to an electrical appliance, which are provided with at least live and neutral terminal pins. The apparatus includes locating means which are engageable by the electrical appliance to locate the appliance in a predetermined position, live and neutral sockets to receive the live and neutral terminal pins, electrical conductors in the sockets, switch means which are actuable by the electrical appliance being placed in a predetermined position to make an electrical connection to at least one of the electrical conductors, and a displaceable member which projects into the sockets and is movable against a bias to actuate the switch means, to prevent risks, e.g. electric shocks and overheating of contacts, and to hinder misuse of the apparatus.

14 Claims, 8 Drawing Figures

ELECTRICAL SOCKET APPARATUS

BACKGROUND OF THE INVENTION

The present invention concerns an electrical socket apparatus of a type which provides sockets to receive the terminal pins of an electrical device. These sockets are provided with electrical conductors for engaging the terminal pins.

An electrical socket apparatus of the socket connector form is well known. Such socket connectors are engageable by electrical devices (such as electrical plug connectors) for connecting an electrical appliance to an electricity supply. However, such socket connectors have various disadvantages. For example, the conductors can be damaged by current arcing because of repeated insertion and removal of the plug connectors while under an electrical load. Also, insertion of worn undersize pins into the sockets may result in poor electrical contact being made with the electrical conductors, thereby resulting in overheating of, and damage to, the socket connector. Dangers can also arise if conductive objects are inserted wrongfully into the sockets.

While some forms of socket connectors are arranged, for example, to reduce heating by spring loading the electrical conductors to bear against the pins, and to reduce these dangers by means of shutters which normally obstruct the sockets until they are displaced by insertion of an appropriate plug connector, these disadvantages, in combination, remain to an appreciable extent.

Such socket connectors have the advantages, firstly, of being simple in construction so that they can be assembled quickly from very inexpensive-to-produce components, and, secondly, of being compact and light so as to be easily transported and fitted into electrical supply circuits or manufactured articles.

An electrical socket apparatus of the appliance supporting form is also known. For example, there are disclosed, in U.S. Pat. Nos. 3,760,149 and 4,096,545, forms of electrical socket apparatus which incorporate safety devices and which serve as base units or stands for cordless appliances, such as electric irons. However, these forms of apparatus have many disadvantages. For example, they are complex, incorporate expensive components, are expensive to construct and assemble, and require expensive modification of the appliance to actuate the safety devices.

It is therefore an object of the present invention to enable all the aforementioned disadvantages to be obviated or reduced.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
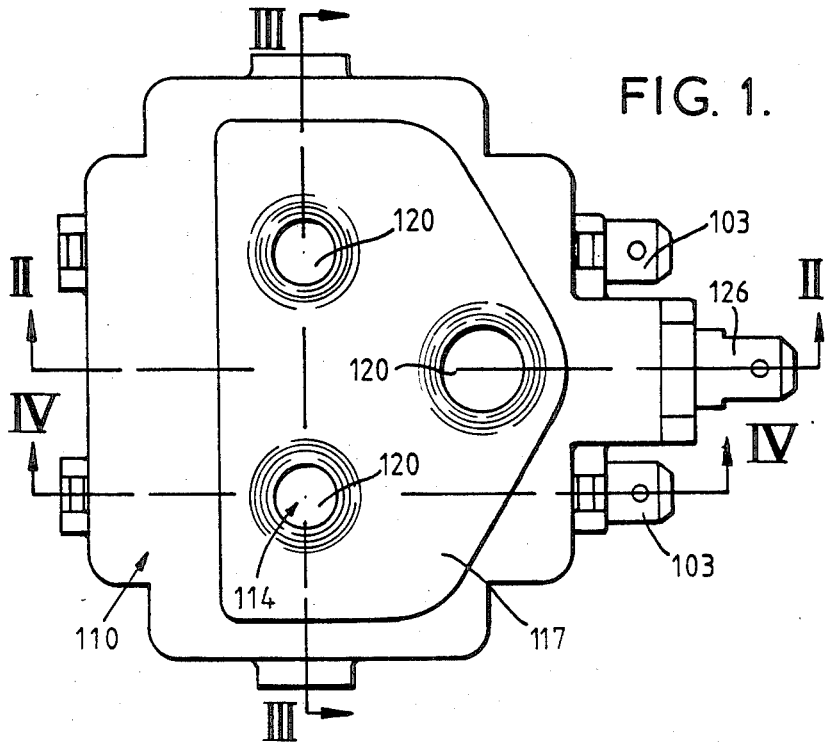
FIG. 1 shows a plan view of the socket apparatus according to the invention.
Figure 2:
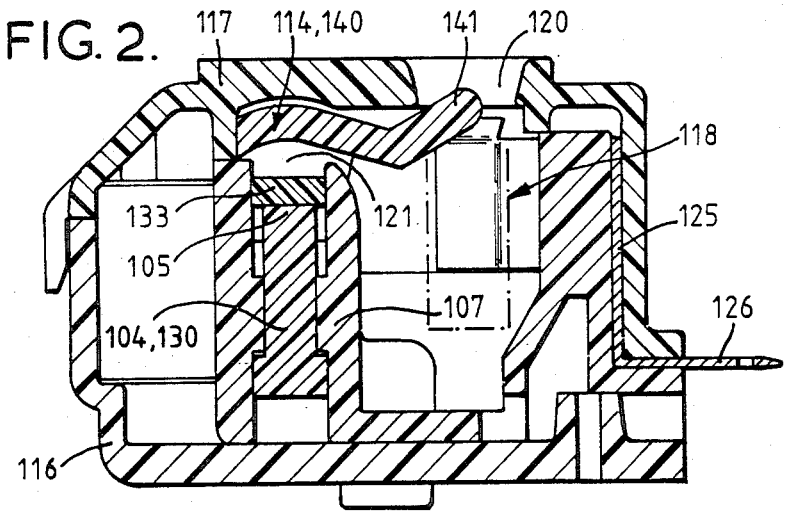
FIG. 2 shows a cross-section of the socket apparatus according to the present invention taken along the lines II—II in FIG. 1.

The invention is characterized primarily in that there is provided an electrical socket apparatus of the type which comprises a displaceable member that extends into at least one of the sockets, and is movable against a bias to actuate a switch to make a connection to at least one of the conductors.

The displaceable member preferably projects into an interior part of the socket, with the interior part being remote from a socket opening in a face of the socket apparatus. The conductor is preferably disposed between the opening and the interior part.

The sockets of the socket apparatus preferably include a live socket, a neutral socket, and an earth socket. A shutter is preferably biased to occupy portions of the live and neutral sockets between the opening and the conductors. This shutter is preferably movable against the shutter bias, by insertion of an earth pin into the earth socket, out of the live and neutral sockets.

A partition is preferably provided between the switch and at least the live and neutral sockets.

There is disclosed herein an embodiment in which the switch has an overcenter action so as to be bistable, i.e. stable in the on (closed) position and stable in the off (open) position. Optional features of the socket apparatus may comprise a manually actuable switch member which is operable to open the switch; and heat responsive means arranged to open the switch when a predetermined temperature is exceeded in the socket apparatus.

However, it has been found that, in order to reduce costs and to increase reliability, the switch is preferably of monostable form, having only a stable off position, so as, in use, to need to be held in an on position.

In order to further improve security against improper attempts to use the socket apparatus, and thereby to further reduce the dangers, the invention provides improved forms of the socket apparatus wherein the displaceable member comprises a balance beam having spaced apart portions which project into a plurality of the sockets. The balance beam is engaged by a fulcrum on a movable switch actuating member, with the spaced apart portions being arranged so that they all require to be displaced to move the balance beam and actuating member through at least a predetermined distance against the bias to cause the switch to close.

In a plurality of the sockets, the conductors preferably rest on the spaced apart portions so as to be movable flexibly therewith by means of the insertion of the pins. This form of the socket apparatus is particularly suitable for use with an appliance support apparatus, such as a stand, for supporting an electrical appliance which is provided with terminal pins, so that the appliance is located in a predetermined position. The appliance and the stand are preferably arranged in such a way so that the weight of the appliance can be utilized to hold the pins in the sockets against ejection forces (which comprise the bias and the spring forces provided by the flexible conductors) tending to eject the pins from the sockets.

The invention includes an appliance support, such as a stand for an electrical appliance having terminal pins, with the appliance support incorporating the socket apparatus according to the present invention.

DESCRIPTION OF THE PREFERRED EMBODIMENT

Referring now to the drawings in detail, in FIGS. 1 to 6, the socket apparatus generally comprises a body 110, switch means 112, a displaceable member 113, a shutter 114, and a cover 115 (not shown in FIGS. 1 to 4).

Figure 5:
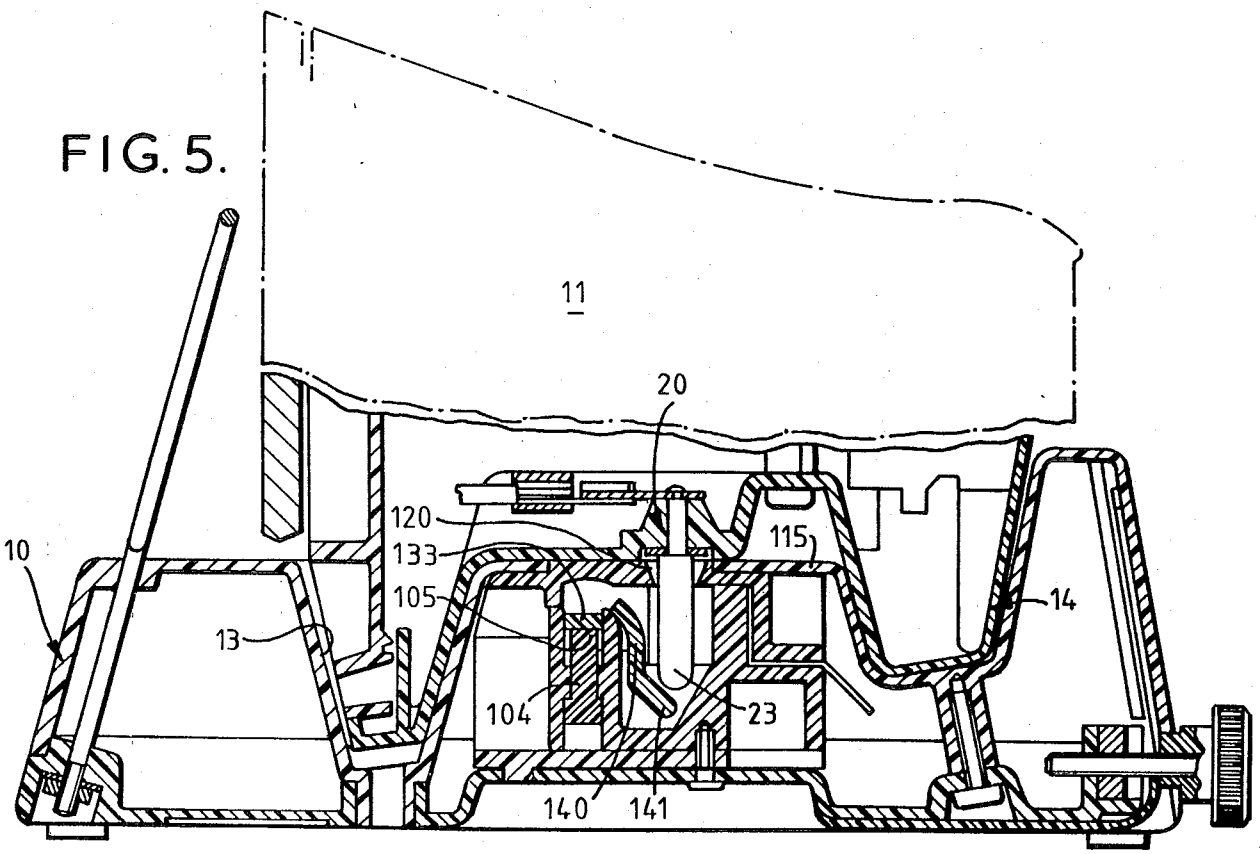
FIGS. 5 and 6 are partial sections through an appliance support apparatus of the invention, including sections through a socket apparatus similar to that shown in FIGS. 2 and 3.
Figure 6:
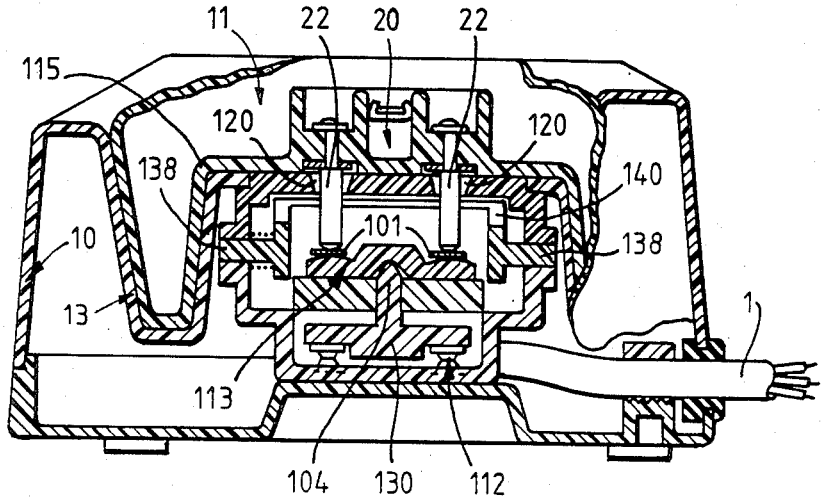

The body 110 includes a back part 116 and a front part 117, which together provide an earth socket 118 and live and neutral sockets 119, indicated in broken lines. These sockets extend inwardly from openings 120 in the front part 117. Each socket is a space within the body 110, which is open to the interior 121 of the body 110, in order to accommodate a respective live pin 22, earth pin 23, or neutral pin 22 of an electrical device, such as a plug connector 20 (as shown in FIGS. 5 and 6).

The body 110 supports an earth conductor or ground 125 and live and neutral conductors 124. The earth conductor or ground 125 extends into the socket 118, for embracing the earth or ground pin 23, and has an input terminal 126. The live and neutral conductors 124 are each U-shaped and have a leaf spring front part 101 which extends across the respective socket 119, and a leaf spring rear part 102 which carries a movable contact 128 of the switch means 112. The part 116 supports two fixed contacts 127 of the switch 112, and each fixed contact 127 is connected to a respective input terminal 103 for connection to an electricity supply via a cable 1 (FIG. 6) of the apparatus.

The switch means 112 has an actuating member 130 slidably mounted by means of a partition 107 of the body. The member 130 is T-shaped in order to provide oppositely directed arms 103, which rest on the rear parts 102, and a central stem 104, which projects forward through the partition 107 in order to provide a fulcrum 105.

The displaceable member 113 comprises a balance member or beam 132, which has a central portion 133 disposed between portions, e.g. arms, 134. These portions 134 project across the sockets 119 behind the parts 101 which rest on the portions or arms 134. The central portion 133 rests on the fulcrum 105 in such a way that the member 113 is urged to a normal position by means of a bias which is provided by the parts 102 and, optionally, also by a bias spring 135, indicated in broken lines. In the normal position, the beam 132 is held spaced apart from a base 136, which is provided by the partition 107 at the rear of each of the live and neutral sockets 119.

Figure 3:
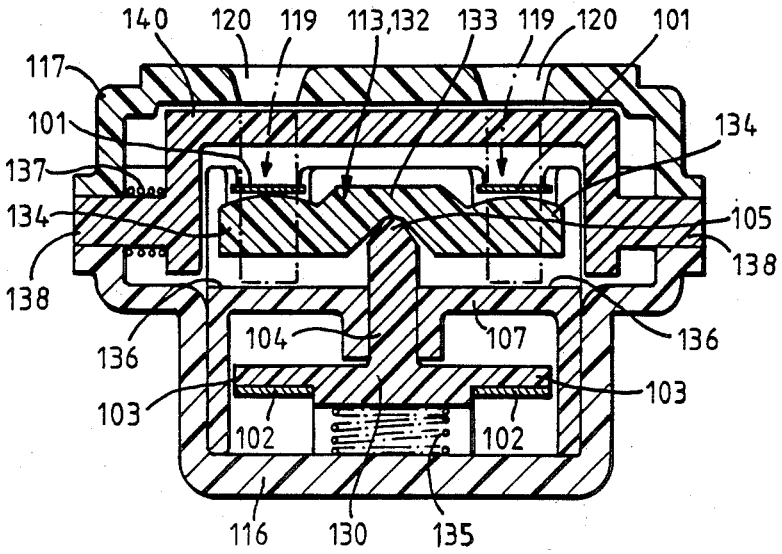
FIG. 3 shows a cross-section of the socket apparatus according to the invention taken along the lines III—III in FIG. 1.
Figure 4:
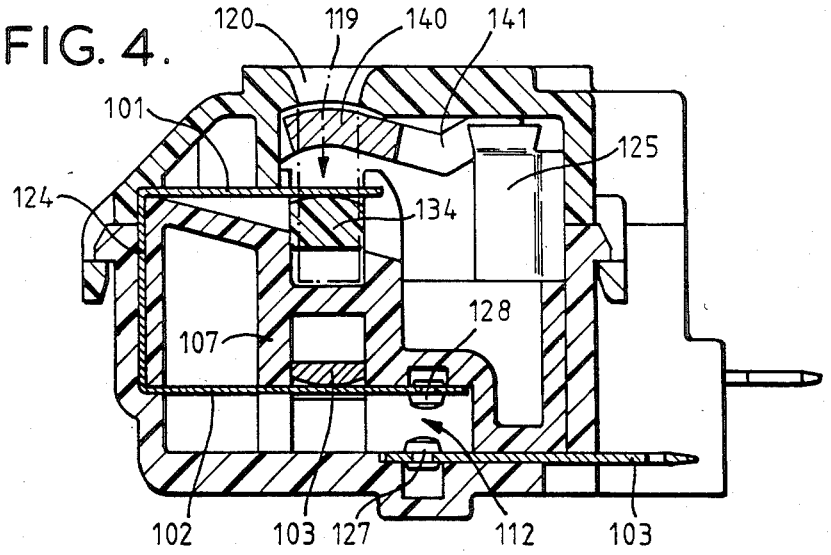
FIG. 4 shows a cross-section of the socket apparatus according to the present invention taken along the lines IV—IV in FIG. 1.

The shutter 114 is pivotally supported by the body 110 and is biased, by a shutter spring 137, to a normal position. In this position, a body 140 of the shutter is disposed between the openings 120 and the live and neutral conductors 124 in such a way as to occupy and block front portions of the live and neutral sockets 119, as shown in FIGS. 1, 3 and 4. Also, in this normal position, an arm 141 of the shutter extends into the earth socket 118. The shutter 114 is supported at each end by trunnions 138, in such a way as to be arcuately movable about an axis which passes through the live and neutral sockets 119.

The socket apparatus is arranged in such a way that, as a plug connector 20 is thrust towards the openings 120 (to cause the earth pin to enter the earth socket 118, to make contact with, and to be gripped by the earth conductor 125), entry of the live and neutral pins into the live and neutral sockets is at first obstructed by the body 140, until the earth pin has moved the arm 141 rearwardly to swing the body 140 away from the live and neutral sockets 119.

Further movement of the pins into the sockets causes the ends of the live and neutral pins to make contact with the live and neutral conductors, while the switch remains open so that the live and neutral conductors are not energized. Further rearward movement causes the live and neutral pins to bend the parts 101 in such a way as to move the beam 132 rearwardly against the bias, thereby causing the arms 103 to bend the parts 102 rearwardly in order to force both of the movable contacts 128 against the respective fixed contacts 127, and thereby close the switch 112.

While the plug connector remains in the fully inserted position, the socket connector will remain in the switched on, in-use, condition shown in FIGS. 5 and 6.

The socket apparatus is arranged to hinder any wrongful attempt to draw electricity e.g. without using a plug connector of a proper form. For example, if a probe, e.g. a pencil, screwdriver or similar implement, is inserted into the earth socket to move the shutter and to reveal the sockets 119, and if thereafter wires or similar conductors are poked into the sockets, 119, then:

(a) the bias and forces provided by the live and neutral conductors will tend to eject these wires, (b) the beam may tilt, as either of, or the first of, the wires is pushed in, to abut the base 136, thus halting rearward movement of the member 130 before the switch is closed, and (c) only the ends of the wires can contact the flat front parts 101, so that if matchsticks or similar non-conductive wedges are used to hold the wires in the sockets, these wedges will, in most cases, abut and move the parts 101 rearwardly from the wires.

The invention is not confined to the details of the foregoing example, and many variations are possible within the scope of the invention as defined by the appended claims. For example, the displaceable member 113, may be arranged to respond also to the insertion and withdrawal of the neutral pin, e.g. it may comprise a balance beam having three arms, one of which is shaped to project into the neutral socket. In this example, the beam is arranged in such a way that all three arms have to be moved rearwardly through predetermined distances before the member 130 is moved rearwardly a sufficient distance to close the switch. The earth or ground conductor may also be in the form of a leaf spring (like the portion 101), and may rest on the third arm of the balance beam, in such a way as to be of non-gripping form.

In the appliance support apparatus shown in FIGS. 5 and 6, a cover 115 of the socket apparatus is shaped to form part of a stand 10 for an appliance 11, e.g. an electric iron, which incorporates a plug connector 20, in order to automatically energize the appliance 11 when the latter is oriented in a predetermined position with respect to the socket apparatus. In the apparatus as shown in FIGS. 5 and 6, the socket apparatus is installed in such a way that its front faces upwardly. The stand 10, and appliance 11, have guide surfaces 13, 14, which, firstly, facilitate the appliance being lowered onto the stand in the correct orientation in order to ensure that the pins are aligned with the sockets, and, secondly, serve as locating means to locate the appliance in a predetermined position on the appliance support apparatus. The openings to the sockets are tapered in order to facilitate entry of the pins, and the sockets within the socket apparatus are wider and broader than the pins in order to accommodate some tilting of the appliance as it is lifted or lowered relative to the stand. In use, the weight of the appliance is utilized to hold the switch closed.

Furthermore, the switch may be modified to be of snap-acting form, by shaping the parts 102 to serve as snap-acting spring blades. The switch means may also be of double pole form in order to make connections to both of said conductors.

Figure 7:
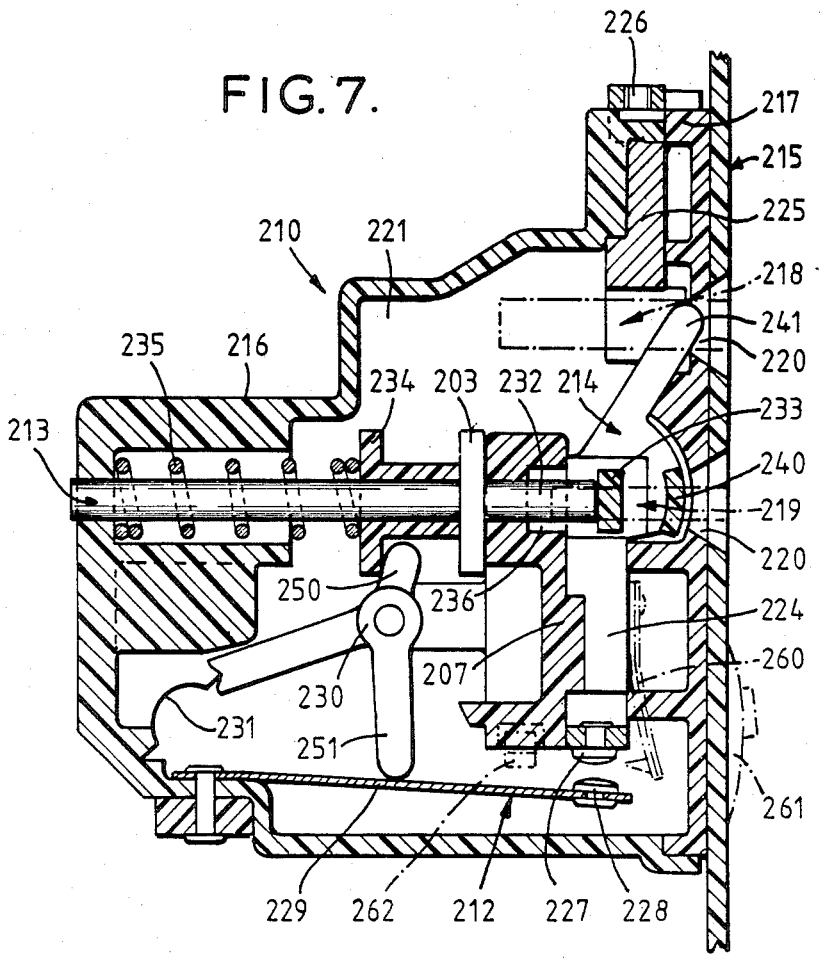
FIG. 7 shows a second embodiment of the socket apparatus according to the invention in vertical cross-section.
Figure 8:
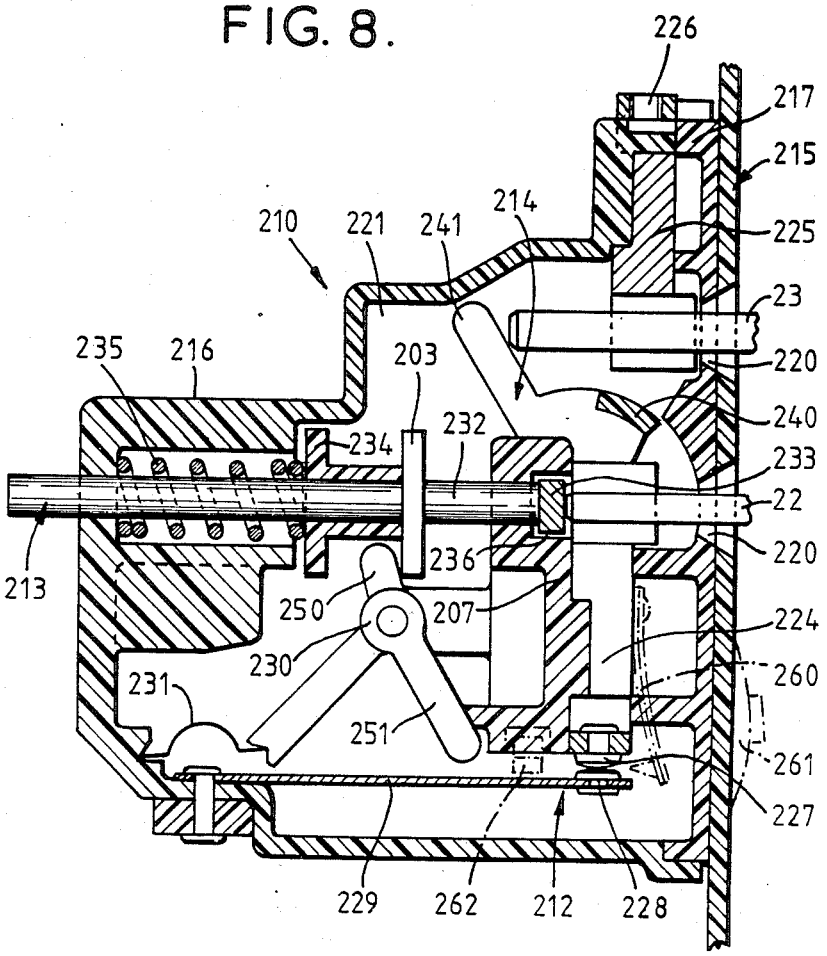
FIG 8. shows this embodiment of the socket apparatus in an in-use condition.

Referring to FIGS. 7 and 8, the socket apparatus generally comprises a body 210, switch means 212, an actuating member 213, a shutter 214, and a cover 215.

The body 210 includes a back part 216 and a front part 217, which together provide an earth or ground socket 218, a live socket 219 (FIG. 7), and a neutral socket (not shown). These sockets extend rearwardly from openings 220 in the front part 217 to a partition 207. Each socket is a space within the body 210, and is open to the interior 221 of the body 210, in order to accommodate a respective live pin 22, earth or ground pin 23, or neutral pin (not shown) of a plug connector as indicated in FIG. 8.

The body 210 supports a neutral conductor (not shown) and live and earth conductors 224 and 225, which extend into the sockets and have parts for embracing the pins. The neutral and earth conductors are provided with respective input terminals, of which only the earth terminal 226 is shown. The live conductor 224 supports a fixed contact 227 of the switch 212, and a movable contact 228 of the switch is connected to a live input terminal (not shown), by means of a spring blade 229.

The switch means 212 has an actuating lever 230, which is pivotally mounted on the partition 207 of the body, and an overcenter spring 231.

The actuating member 213 comprises a rod 232, which is provided with a fixed flange 203 and a collar 234, and is urged to a normal position (FIG. 7) by means of a bias spring 235. In the normal position, a fulcrum portion of the rod 232 projects through the partition 207 to support a central part of a displaceable member 233, e.g. a balance beam. This member 233 preferably extends into an inner portion 236 of the live and neutral socket 219 which is located to the rear of the live and neutral conductors, but it may alternatively extend between the pin gripping parts of the conductors, as indicated diagrammatically in FIGS. 7 and 8.

The shutter 214 is pivotally supported by the body 210 and is biased, by a shutter spring, not shown, to a normal position. In this normal position, portion 240 of the shutter is disposed between openings 220 and the live and neutral conductors, in such a way as to occupy and block front portions of the live and neutral sockets, as shown in FIG. 7, and arm 241 of the shutter extends into the earth or ground socket 218.

The socket apparatus is arranged in such a way that, as a plug connector is thrust towards the cover 215 in order to cause the earth pin to enter the earth socket 218, entry of the live and neutral pins into the live and neutral sockets is obstructed by the portion 240, until the earth or ground pin moves the arm 241 rearward, after making contact with the earth or ground conductor 225, to raise the portions 240 from the live and neutral sockets.

Further movement of the pins into the sockets causes the live and neutral pins to make contact with the live and neutral conductors, while the switch remains open, so that the live conductor is not energized.

After the live pin has moved across the live conductor, further rearward movement causes the live and neutral pins to engage the balance member 233 in such a way as to move the rod 232 rearwardly against the bias, thereby causing the flange 203 to move an arm 250 of the lever 230 rearwardly in order to rotate the lever anti-clockwise against the thrust of the spring 231, until the spring 231 passes a point of maximum compression. Thereafter, the spring 231 urges the lever 230 anti-clockwise, causing an arm 251 of the lever to lift rapidly from the blade 229 and allowing the switch 212 to close rapidly and energize the live conductor.

While the plug connector remains in position, the socket apparatus will remain in the in-use condition shown in FIG. 8.

When the plug connector is withdrawn, the initial withdrawal of the live and neutral pins from the rear portions 236 of the live socket allows the spring 235 to move the beam 233 and the rod 232 forward in order to cause the collar 234 to engage and to move the arm 250 forward against the thrust of the spring 231, until the point of maximum compression is passed, whereupon the spring 231 rapidly rotates the lever 230 clockwise in order to cause the arm 251 to strike the blade 229 and to open the switch rapidly before the live and neutral pins have been withdrawn from the conductors.

Thereafter, removal of the pins from the sockets allows the shutter to be moved clockwise by means of the shutter spring in order to restore the portions 240 to the front portions of the live and neutral sockets.

The invention is not confined to the details of the foregoing example, and many variations are possible within the scope of the invention as defined by the appended claims. For example, a heat sensitive element 260 may be secured to the live conductor in order to open the switch 212 if the temperature of the element 260 rises above a predetermined limit. Also, a manually operable switch member 261 may be provided to move a switch lever 262 in order to open the switch 212, when the plug connector is in situ. Such an arrangement has the advantage that manual operation of the member 261 cannot cause the live conductor to be energized in the absence of the plug connector.

The cover 215 is optional, and may form part of a housing, support, stand, or locator of the appliance support apparatus, for supporting an appliance which incorporates a plug connector, to automatically energize the appliance when the latter is appropriately oriented with respect to the socket apparatus. However, due to the pin gripping form of the live neutral and earth conductors and the fact that the spring 235 may have only a small strength to minimize the pin ejection forces, this form of the socket apparatus is particularly suitable for use as a socket connector, e.g. for mounting on a wall of a house or office, to receive an ordinary plug connector.

This embodiment of the socket apparatus of the invention substantially avoids the aforementioned disadvantages, and has the particular advantage that attempts to use the socket connector wrongly, by displacing the shutter with a probe and by inserting wires or other conductive objects into the live and neutral sockets, will usually be frustrated by non-actuation of the switch or by the frictional grip of the live conductor on such an object being insufficient to retain the object against the thrust of the spring 235.

The invention also includes electrical apparatus which comprise an appliance, such as an electric smoothing iron, that incorporates a plug connector in combination with a stand, for the appliance. The stand incorporates the socket apparatus of the present invention, with the appliance being arranged in such a way that, when the appliance is supported upon the stand in a predetermined position, the appliance is automatically energized. The stand and appliance may comprise guide means in order to facilitate the appliance being moved into position. Both embodiments of socket apparatus have the advantage that the strength of the springs 102, 135, and 235 may be selected to suit the weight of the appliance. However, for use in the appliance support apparatus, e.g. with a stand, the first embodiment of the socket apparatus derives additional important advantages from the use of non-gripping conductors 124, which abut the ends of the pins 22, or 22 and 23, and also from the oversize sockets 119 which accommodate some misalignment of the pins 22, or 22 and 23.

In all embodiments the balance member 133 or 233 may be modified in shape. It may be disposed below, or to the rear of, the partition 107, 207, and may have portions which extend through the partition. Or, the balance member 133 or 233 may be enlarged to serve as a "floating" or movable partition (instead of the partition 107 or 207) between the sockets and the switch in order to prevent access to the unswitched live and neutral conductors 103 or 229.

The present invention is, of course, in no way restricted to the specific disclosure of the specification and drawings, but also encompasses any modifications within the scope of the appended claims.

What I claim is:

1. An electrical apparatus which comprises:

an electrical appliance which is provided with a first and a second guide surface, and with at least live and neutral terminal pins located between said first and said second guide surfaces; and an appliance support apparatus which is provided with a first and a second guide surface, with said first and said second guide surfaces being slidably engageable with said first and said second guide surfaces of said appliance to locate said appliance in a predetermined position; said support apparatus also being provided with live and neutral sockets for receiving said live and neutral terminal pins therein, said sockets being disposed between said first and said second guide surfaces of said support apparatus; electrical conductors being disposed within each of said sockets; switch means being located on said support apparatus between said guide surfaces, said switch means being actuable by said appliance when it is placed in a predetermined position, thereby making an electrical connection to at least one of said electrical conductors; and with said support apparatus further including a displaceable member which projects into said sockets and is movable against a bias to actuate said switch means.

2. An electrical apparatus according to claim 1, in which said displaceable member includes a balance member which is provided with a plurality of portions that project into said sockets, said balance member being engageable by a fulcrum on a movable switch actuating member provided on said switch means, and with said portions of said balance member being arranged in such a way that displacement of said balance member and said actuating member through at least a predetermined distance against said bias causes said switch means to close.

3. An electrical apparatus according to claim 1, in which said electrical conductors abut said displaceable member and are flexibly movable by contact with a first end which is provided on each of said terminal pins.

4. An electrical apparatus according to claim 1, in which said sockets include a live socket, a neutral socket, and a ground socket; and in which said live and said neutral sockets are each provided with front portions, said sockets further being provided with a shutter which is biased to occupy said front portions between said openings of said sockets and said electrical conductors, with said shutter being movable against said shutter bias out of said front portions.

5. An electrical apparatus according to claim 1, in which said electrical apparatus is arranged in such a way that the weight of said appliance can be utilized to hold said terminal pins in said sockets against ejection forces tending to eject said pins from said sockets.

6. An electrical apparatus according to claim 1, in which said switch means comprises a double pole form so as to make connections to both of said electrical conductors.

7. An electrical socket apparatus which provides sockets to receive terminal pins of an electrical device and which comprises:

sockets, each of which has a first end and a second end, and also has an interior part which extends therebetween, said sockets further being provided with electrical conductors for engaging terminal pins which are provided on an electrical appliance;

a displaceable member which extends into at least one said second end of said sockets, and is movable about a bias to make an electrical connection to at least one of said electrical conductors; and a switch means which is operatively connected to said displaceable member and is actuated by its movement about said bias.

8. An electrical socket apparatus according to claim 7, in which said displaceable member projects into said interior part of said socket, with said interior part being disposed remote from a socket opening which is located on said first end of said socket, and with said electrical conductor being disposed between said opening and said interior part.

9. An electrical socket apparatus according to claim 7 in which said sockets include a live socket, a neutral socket, and a ground socket; and in which said live and said neutral sockets are each provided with front portions, said sockets further being provided with a shutter which is biased to occupy said front portions between said openings of said sockets and said electrical conductors, with said shutter being movable against said shutter bias out of said front portions.

10. An electrical socket apparatus according to claim 7, in which said socket apparatus is incorporated into an appliance support apparatus, for supporting and supplying electricity to an electrical appliance having live and neutral terminal pins.

11. An electrical socket apparatus according to claim 7, in which said electrical socket apparatus is arranged in such a way that the weight of said appliance can be utilized to hold said terminal pins in said sockets against ejection forces tending to eject said pins from said sockets.

12. An electrical socket apparatus according to claim 7, in which said switch means comprises a double pole form so as to make connections to both of said electrical conductors.

13. An electrical socket apparatus according to claim 7, in which said displaceable member includes a balance member which is provided with a plurality of portions that project into a plurality of said sockets, said balance member being engageable by a fulcrum on a movable switch activating member which is provided on said switch means, and with said portions of said balance member being arranged in such a way that displacement of said balance member and said actuating member through at least a predetermined distance against said bias causes said switch means to close.

14. An electrical socket apparatus according to claim 13, in which said portions are spaced apart from one another and, in a plurality of said sockets, said electrical conductors rest on said spaced apart portions in such a way as to be movable flexibly therewith by insertion of the pins.

* * * * *